US009410545B2

(12) United States Patent
Nirenberg

(10) Patent No.: US 9,410,545 B2
(45) Date of Patent: Aug. 9, 2016

(54) SOLID STATE BILGE PUMP SWITCH

(75) Inventor: David B. Nirenberg, Bonita Springs, CA (US)

(73) Assignee: Lake Red Rock LLC, Ankeny, IA (US)

( * ) Notice: Subject to any disclaimer, the term of this patent is extended or adjusted under 35 U.S.C. 154(b) by 692 days.

(21) Appl. No.: 13/486,475

(22) Filed: Jun. 1, 2012

(65) Prior Publication Data

US 2013/0140912 A1 Jun. 6, 2013

Related U.S. Application Data

(60) Provisional application No. 61/492,622, filed on Jun. 2, 2011.

(51) Int. Cl.
*H01H 45/00* (2006.01)
*F04B 49/02* (2006.01)

(52) U.S. Cl.
CPC ..... *F04B 49/02* (2013.01); *Y10T 307/779* (2015.04)

(58) Field of Classification Search
CPC ..... H01H 45/00; B63B 13/00; B63B 29/16; B63B 4/00; B63B 3/00; B63B 3/44; G05D 9/12; G01F 23/265; F04D 15/128
USPC ..... 307/118; 114/183 R
See application file for complete search history.

(56) References Cited

U.S. PATENT DOCUMENTS

| | | | | |
|---|---|---|---|---|
| 4,766,329 | A * | 8/1988 | Santiago | G05D 9/12 307/116 |
| 6,218,948 | B1 * | 4/2001 | Dana | G01F 23/265 340/604 |
| 2004/0018094 | A1 * | 1/2004 | Rossman | F04D 15/0218 417/40 |
| 2006/0005622 | A1 * | 1/2006 | Burdi | F04D 15/0218 73/304 C |

* cited by examiner

*Primary Examiner* — Rexford Barnie
*Assistant Examiner* — Joseph Inge

(57) ABSTRACT

A switch for a bilge pump of a boat includes a pair of probes for providing a probe signal indicating the presence of fluid at the probes, a current sensor for providing a sensor signal indicating electric current of the pump; and a controller programmed to energize the pump when a threshold level of the probe signal indicates the presence of fluid and to de-energize the pump when a threshold level of the sensor signal indicates that the pump is not pumping fluid. The controller can also be programmed to dynamically change the threshold level of the probe signal based on a prior probe signal that indicates changing probe conditions.

11 Claims, 3 Drawing Sheets

SOLID STATE BILGE PUMP SWITCH

CROSS-REFERENCE TO RELATED APPLICATIONS

The application claims the priority benefit of U.S. provisional patent application No. 61/492,622 filed on Jun. 2, 2011, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to sensors for detecting the presence of fluids for activating a pump, and more specifically, to fluid sensors mounted in boat bilge tanks for activating a bilge pump when bilge fluid reaches a preset level above the bottom of the bilge tank.

BACKGROUND OF THE INVENTION

Bilge pumps in boats or ships must be activated before accumulating water reaches an excessive level. Early bilge pumps were activated manually or by mechanical switches such as those that have floats with contacts to complete electrical circuits and activate the bilge pumps. These mechanical switches typically performed as desired when initially installed on the boats. However, bilge debris and other contamination built up over time and/or caused corrosion to prevent the mechanical components from moving as intended. Additionally, these mechanical switches had relatively short lives compared to the boats in which they were installed and required replacement.

In an attempt to solve these problems with mechanical switches, electronic switches without moving parts were developed. Typically, these electronic switches utilize the conductivity of the water to be sensed with probes to activate the bilge pumps. These electronic switches are susceptible to false alarms, which can b "burn up" the pump motor, and missed detections, which can sink or damage the boat, once contamination in builds up around the probes, sloshing bilge water contacts the switch, and/or there are changing environmental conditions around the switch.

Many attempts have been made to solve these problems with electrical capacitive switches. Coated water repellant probes have been used. For example, see U.S. Pat. No. 4,276,454, the disclosure of which is expressly incorporated herein in its entirety by reference. Ultrasonic field detection has been utilized. For example, see U.S. Pat. No. 4,881,873, the disclosure of which is expressly incorporated herein in its entirety by reference. Acoustic transducers have been utilized. For example, see U.S. Pat. No. 4,897,822 , the disclosure of which is expressly incorporated herein in its entirety by reference. Time delays have been utilized. For example, see U.S. Pat. No. 5,404,048 , the disclosure of which is expressly incorporated herein in its entirety by reference. Optical fibers have been utilized. For example, see U.S. Pat. No. 5,425,624 , the disclosure of which is expressly incorporated herein in its entirety by reference. Field effect "touch sensors" have been utilized. For example, see U.S. Pat. No. 7,373,817 , the disclosure of which is expressly incorporated herein in its entirety by reference. While these attempts may have been somewhat successful in reducing false alarms and missed detections, they are either not completely successful or relatively expensive solutions. Accordingly, there is a need for improved bilge pump switches that are less costly and reduce false alarms and missed detections.

SUMMARY OF THE INVENTION

Disclosed herein are bilge pump switches which overcome at least one of the deficiencies of the prior art. Disclosed is a switch for a bilge pump comprising, in combination, a pair of probes for providing a probe signal indicating the presence of fluid at the probes, a current sensor for providing a sensor signal indicating electric current of the pump, and a controller programmed to energize the pump when a threshold level of the probe signal indicates the presence of fluid and to de-energize the pump when a threshold level of the sensor signal indicates that the pump is not pumping fluid.

Also disclosed is a switch for a bilge pump comprising, in combination, a pair of probes for providing a probe signal indicating the presence of fluid at the probes, and a controller programmed to energize the pump when a threshold level of the probe signal indicates the presence of fluid. The controller is programmed to dynamically change the threshold level of the probe signal based on a prior probe signal that indicates changing probe conditions.

From the foregoing disclosure and the following more detailed description of various preferred embodiments it will be apparent to those skilled in the art that the present invention provides a significant advance in the technology and art of bilge pump switches. Particularly significant in this regard is the potential the invention affords for providing a reliable and low cost switch. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
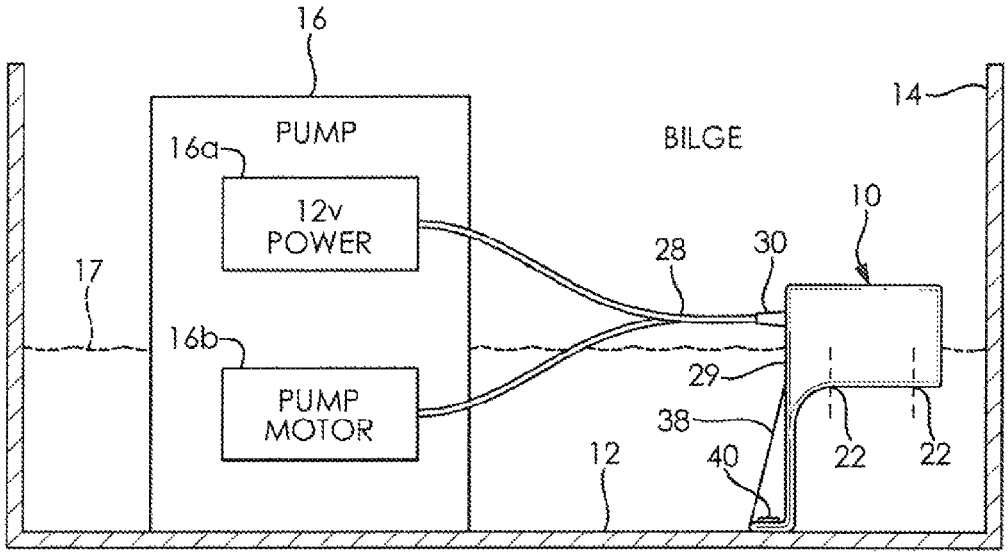
FIG. 1 is a schematic view of a bilge pump system of a boat according to the present invention.
Figure 2:
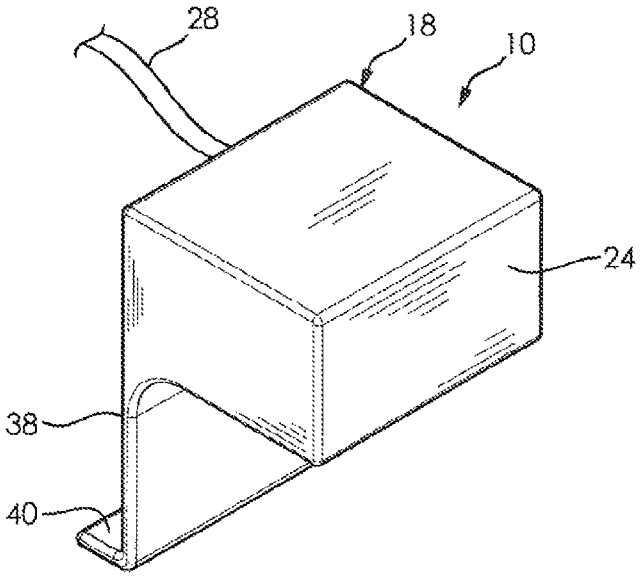
FIG. 2 is a perspective view of bilge pump switch of the system of FIG. 1.
Figure 3:
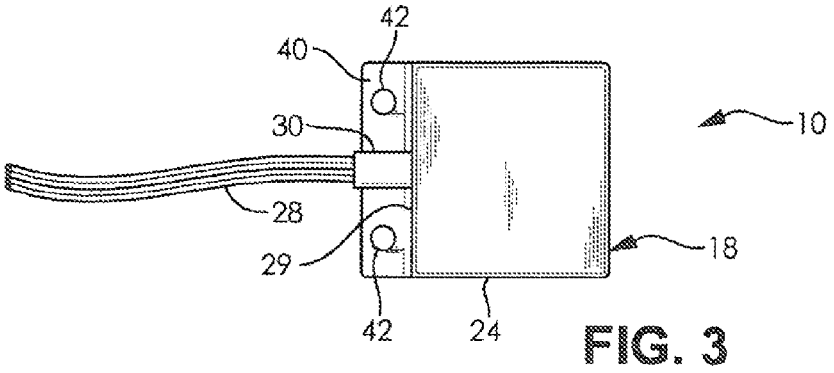
FIG. 3 is a top plan view of the bilge pump switch of FIG. 2.
Figure 4:
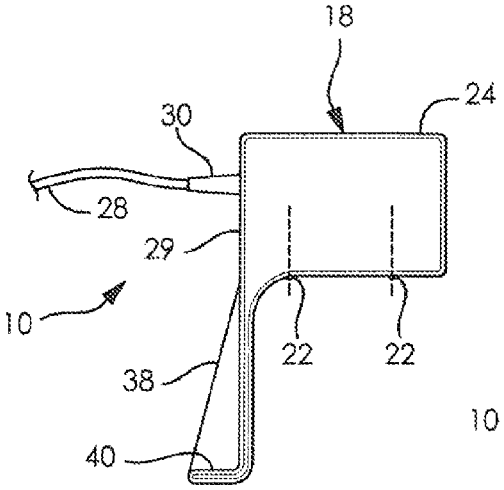
FIG. 4 is a right-side elevational view of the bilge pump switch of FIGS. 2 and 3.
Figure 5:
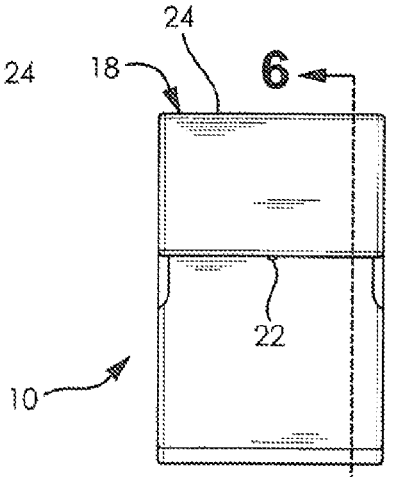
FIG. 5 is a front elevational view of the bilge pump switch of FIGS. 2 to 4.
Figure 6:
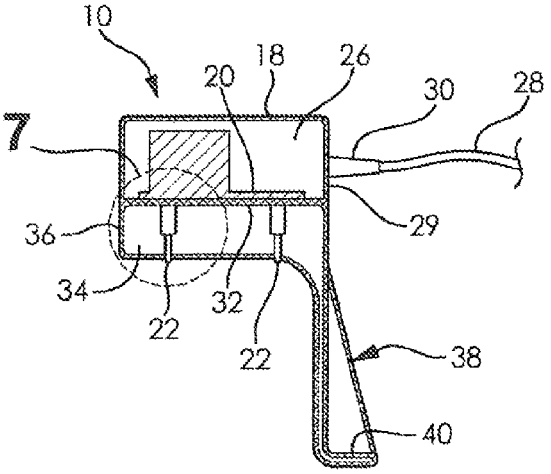
FIG. 6 is a sectional view taken along line 6-6 of FIG. 5.
Figure 7:
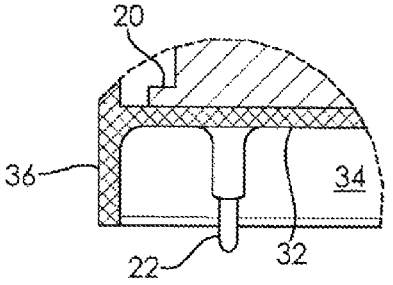
FIG. 7 is an fragmented, enlarged view taken along line 7 of FIG. 6.

It should be understood that the appended drawings are not necessarily to scale, presenting a somewhat simplified representation of various preferred features illustrative of the basic principles of the invention. The specific design features of the bilge pump switch as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the bilge pump switches illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved bilge pump switches disclosed herein. The following detailed discussion of various alternative and preferred embodiments will illustrate the general principles of the invention. Other embodiments suitable for other applications will be apparent to those skilled in the art given the benefit of this disclosure.

Referring now to the drawings, FIGS. 1 to 8 illustrate a bilge pump switch 10 according to the present invention. The illustrated bilge switch 10 is mounted at the bottom of a bilge in a boat 14 and is electrically connected to a 12 volt, direct-current bilge pump 16 in order to selectively energize the pump and evacuate the water 17 and other bilge fluids in the bilge 12 of the boat 14. As best shown in FIGS. 2 to 7, the illustrated bilge pump switch 10 includes a protective case or housing 18 , an electronic circuit 20 within the protective case 18, and a pair of probes 22 electrically connected to the electronic circuit 20 and extending from the protective case 18 to act as a water level sensor. The electronic circuit 20 monitors the water level within the bilge 12 via the two probes 22 and energizes the bilge pump 16 only when the water 17 or other bilge fluids within the bilge 12 reaches the level of the probes 22. The illustrated electronic circuit 20 also monitors current flow in the bilge pump 16 and shuts off the bilge pump 16 when the bilge 12 is empty of water 17 and other bilge fluids and the bilge pump 16 is not pumping fluid. The illustrated electronic circuit 20 dynamically changes a threshold or trigger signal value for the probes 22 based on changing probe conditions in order to reduce false triggers and enhance the reliability of the bilge pump 16 to control the water level within the bilge 12.

The illustrated case or housing 18 is molded of plastic but it is noted that the protective case 18 can alternatively be formed in any other suitable manner and/or the protective case 18 can alternatively comprise any other suitable material. The illustrated protective case 18 has an upper portion that forms a water-tight sealed interior space or cavity 26 for the electronic circuit 20. The illustrated bilge pump switch 10 has four electrical wires 28 that exit through a rear wall 29 of the upper portion 24 to electrically connect the electronic circuit 20 within the protective case 18 with the bilge pump 16. It is noted that alternatively there can be other quantities of wires 28 if desired and/or that the wires 28 can all be located within a single cable sleeve if desired. The illustrated electrical wires 28 are provided with a water-tight grommet 30 to seal the interior cavity 26 of the protective case 18 but alternatively any other suitable manner of sealing the wires 28 can be used. The probes 22 downwardly extend from a bottom wall 32 of the upper portion 24. The illustrated upper portion 24 forms a downwardly facing recess 34 in which the probes 22 are at least partially located. A wall 36 forming the recess 34 encircles the probes 22 and at least partially protects the probes 22 from sloshing, splashing, and the like of water 17 and other bilge fluids located in the bilge 12. The recess also at least partially protects the probes 22 from contact with debris floating in the bilge 12 which may damage the probes 22 or cause false readings. The illustrated protective case 18 also has a lower portion 38 downwardly extending from the upper portion 24. The illustrated lower portion 38 has a horizontally-extending mounting flange 40 at its lower end. The illustrated mounting flange 40 is provided with a pair of openings or holes 42 for receiving mechanical fasteners to mount the bilge pump switch 10 to the bottom or floor of the bilge 12. It is noted that the bilge pump switch 10 can alternatively be mounted to the bilge 12 in any other suitable manner. The lower portion 38 is sized and shaped to support the upper portion 24 and to position the probes 22 at a desired height above the floor of the bilge 12 at which it is desired to energize the bilge pump 16 to remove the water 17 from the bilge 12.

The illustrated probes 22 comprise stainless steal but any other suitable material can alternatively be utilized. The illustrated pair of probes 22 are vertically extending, parallel, and horizontally spaced apart a suitable distance for providing a signal when the water 17 or other bilge fluid contacts the probes 22 to connect the circuit between the probes 22 to indicate that the water 17 in the bilge 12 has reached the level of the probes 22 in a known manner. The probes 22 are in electrical communication with the electronic circuit 20 (best shown in FIG. 8).

Figure 8:
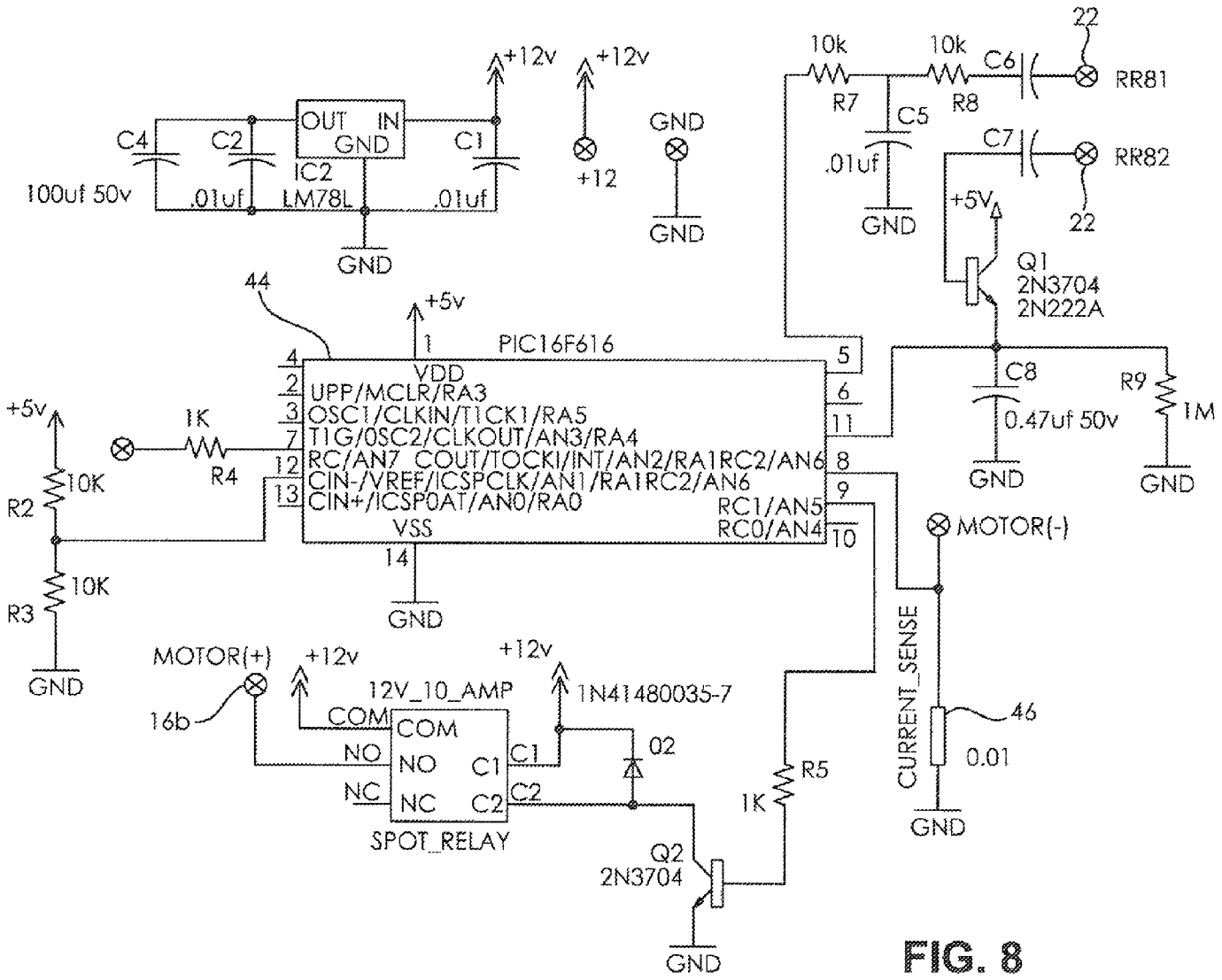
FIG. 8 is schematic view of an electronic circuit of the bilge pump switch of FIGS. 2 to 7.

As best shown in FIG. 8, the illustrated electronic circuit 20 includes a controller or microcontroller 44 and other electrical components (such as, for example, capacitors, resistors, diodes, transistors, relays, and the like) configured to provide the operations and functions described herein. The illustrated controller 44 is a 14-pin, flash based, 8 bit CMOS microcontroller but it is noted that any other suitable type of controller can alternatively be utilized. A suitable microcontroller is part no. PIC16F616/16HV616 available from Microchip technology Inc. of Chandler, Ariz. The electronic components are mounted on at least one circuit board located within the sealed interior cavity 26 of the protective case 18.

The illustrated microcontroller 44 is programmed to supply a one kilohertz, fifty percent duty cycle signal to one of the probes 22 through a conditioning filter and a decoupling capacitor. It is noted that any other suitable duty cycle can alternatively be utilized. The signal occurs at a pre determined interval programmed or embedded in the microcontroller. The microcontroller 44 loops thru a test routine at this interval value to check the status of the probes 22. If water 17 or other bilge fluids within the bilge 12 is not high enough to cover the probes 22 and provide a signal at or beyond a threshold signal level, the microcontroller 44 enters a sleep state until the predetermined time passes and the loop begins again. However, when water 17 and/or other bilge fluid capable of conducting current covers both of the probes 22 so that a signal at or above the threshold signal level is picked up by the second probe 22, which is also decoupled thru a capacitor, and the microcontroller 44 enters a test subroutine. This test routine first energizes the bilge pump 16 and measures the current through the bilge pump 16 via a current sensor 46. The current sensor 46 can be of any suitable type such as, for example a current sensing resistor. Because the current through the bilge pump 16 is proportional to the work being done by the bilge pump 16, the microcontroller 44 can determine if the bilge pump 16 is pumping water or 17 just spinning in air. It is noted that any other suitable pump value or variable can alternatively be monitored rather than the pump current. A threshold current value indicating the pumping of water is predetermined and programmed or embedded in the microcontroller 44. If the current through the bilge pump 16 is at or above the threshold current value, the microcontroller 44 permits the bilge pump 16 to continue to operate until the current through the bilge pump 16 drops below this threshold current value as the water 17 and/or other bilge fluid is fully evacuated from the bilge 12. If the bilge pump 16 is falsely triggered by the probe signal due to high humidity or residual moisture or contamination around the probes 22 as indicated by the current through the bilge pump 16 being below the threshold current value, the microcontroller 44 immediately shuts off the bilge pump 16 and the actual probe signal strength is averaged into the probe threshold signal level. This adjustment of the threshold signal level allows the probe threshold signal level to constantly follow or adjust for any environmental changes or help compensate for any dielectric build up due to dirty liquid coming in contact with the probes 22. It is noted that the threshold signal level can alternatively be adjusted other any other suitable amount rather than the illustrated averaging. For example, the threshold signal level could be adjusted less than 50% of the difference (such as, for example 25% of the difference) if a slower adjustment is desired or more than 50% of the difference (such as, for example 75% of the difference) if a faster adjustment is desired.

It is noted that each of the features and variations of the above disclosed embodiments can be used in any combination which each of the other embodiments.

From the foregoing disclosure it is apparent that by monitoring the current draw of the bilge pump 16, the bilge pump 16 operates only as long as it takes to completely evacuate the bilge 12 of water 17 and other bilge fluids. Prior art bilge pumps operate for a predetermined time period regardless of the capacity of the bilge. Operating for predetermined time periods can result in the pump running dry for long periods and thus reducing the life of the pump. It is also apparent that by keeping a running average of the probe signal strength, the bilge pump switch 10 has the ability to intelligently determine the state of the water level in the bilge 12. The signal strength can vary due to changing environmental conditions or the accumulation of dirt on the probes 22. Changing conditions and or dirty probes 22 can result in damage to the bilge pump 16 by running it dry, or the probes 22 not triggering at all resulting in a sinking boat 14.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A switch for a bilge pump located in a bilge, the switch comprising, in combination:

a pair of probes for providing a probe signal indicating the presence of fluid at the probes;

a current sensor for providing a sensor signal indicating electric current of the bilge pump;

a controller in communication with the probes to receive the probe signal and in communication with the current sensor to receive the sensor signal;

a housing having an upper portion and a lower portion;

wherein the upper portion of the housing includes a water-tight sealed interior cavity having a bottom wall and a wall forming a downward-facing recess below the bottom wall and open at a bottom of the upper portion and facing a bottom of the bilge so that water located within the bilge can rise into the downward-facing recess;

wherein the controller is located within the water-tight sealed interior cavity;

wherein the pair of probes downwardly extend from the bottom wall and are at least partially located within the downward-facing recess of the upper portion of the housing and are electrically connected with the controller through the bottom wall;

wherein the lower portion downwardly extends from the upper portion and has a horizontally-extending mounting flange at a lower end to mount the housing to the bottom of the bilge and wherein the lower portion is configured to support the upper portion and position the probes at a height above the bottom of the bilge at which it is desired to energize the bilge pump to remove water from within the bilge;

wherein the controller is programmed to energize the bilge pump when the probe signal is above a threshold level of the probe signal that indicates the presence of fluid at the pair of probes; and wherein the controller is programmed to compare the sensor signal to a threshold level of the sensor signal that indicates the bilge pump is not pumping fluid when the bilge pump is initially energized and to de-energize the bilge pump if the sensor signal is below the threshold level of the sensor signal that indicates the bilge pump is not pumping fluid.

2. The switch according to claim 1, wherein the controller is programmed to dynamically change the threshold level of the probe signal based on prior probe signals that indicate changing probe conditions.

3. The switch according to claim 1, wherein the wall forming the downward-facing recess encircles the pair of probes.

4. The switch according to claim 2, wherein the controller is programmed to dynamically change the threshold level of the probe signal by adjusting the threshold level of the probe signal by averaging actual probe signal levels that cause false signals of fluid at the probes into the threshold level of the probe signal.

5. The switch according to claim 1, wherein the horizontally-extending mounting flange has openings for receiving mechanical fasteners to mount the housing to the bottom of the bilge.

6. The switch according to claim 1, wherein wires for electrically connecting the controller to the bilge pump extend from the controller and exit the water-tight sealed interior cavity through a rear wall of the upper portion that partially forms the water-tight sealed interior cavity, and wherein the wires are provided with a water-tight grommet at the rear wall.

7. A switch for a bilge pump, the switch comprising, in combination:

a pair of probes for providing a probe signal indicating the presence of fluid at the probes;

a controller programmed to energize the bilge pump when the probe signal is above a threshold level of the probe signal that indicates the presence of fluid at the pair of probes;

a housing having an upper portion and a lower portion;

wherein the upper portion of the housing includes a water-tight sealed interior cavity having a bottom wall and a wall forming a downward-facing recess below the bottom wall and open at a bottom of the upper portion and facing a bottom of the bilge so that water located within the bilge can rise into the downward-facing recess;

wherein the controller is located within the water-tight sealed interior cavity;

wherein the pair of probes downwardly extend from the bottom wall and are at least partially located within the downward-facing recess of the upper portion of the housing and are electrically connected with the controller through the bottom wall;

wherein the lower portion downwardly extends from the upper portion and has a horizontally-extending mounting flange at a lower end to mount the housing to the bottom of the bilge and wherein the lower portion is configured to support the upper portion and position the probes at a height above the bottom of the bilge at which it is desired to energize the bilge pump to remove water from within the bilge;

wherein the controller is programmed to dynamically change the threshold level of the probe signal based on a prior probe signal that indicates changing probe conditions; and wherein the controller is programmed to dynamically change the threshold level of the probe signal by adjusting the threshold level of the probe signal by averaging an actual probe signal level that caused a false signal of fluid at the probes into the threshold level of the probe signal.

8. The switch according to claim 7, further comprising a current sensor for providing a sensor signal indicating electric current of the bilge pump and wherein the controller is programmed compare the sensor signal to a threshold level of the sensor signal that indicates the bilge pump is not pumping fluid when the bilge pump is initially energized and to de-energize the bilge pump if the sensor signal is below the threshold level of the sensor signal that indicates the bilge pump is not pumping fluid.

9. The switch according to claim 7, wherein the wall forming the downward-facing recess encircles the pair of probes.

10. The switch according to claim 7, wherein the horizontally-extending mounting flange has openings for receiving mechanical fasteners to mount the housing to the bottom of the bilge.

11. The switch according to claim 7, wherein wires for electrically connecting the controller to the bilge pump extend from the controller and exit the water-tight sealed interior cavity through a rear wall of the upper portion that partially forms the water-tight sealed interior cavity, and wherein the wires are provided with a water-tight grommet at the rear wall.

* * * * *